United States Patent [19]

Cherundolo et al.

[11] Patent Number: 4,595,141

[45] Date of Patent: Jun. 17, 1986

[54] DRIVE NOZZLE ASSEMBLY FOR A REACTION DRIVE SPRINKLER

[75] Inventors: Michael Cherundolo, Upland; Charles A. McMillen, Alta Loma, both of Calif.

[73] Assignee: Rain Bird Sprinkler Mfg. Corp., Glendora, Calif.

[21] Appl. No.: 714,994

[22] Filed: Mar. 22, 1985

[51] Int. Cl.[4] ..... B05B 3/08

[52] U.S. Cl. ..... 239/230; 239/233; 239/248

[58] Field of Search ..... 239/225, 229, 230, 231, 239/232, 233, 246, 248, 251

[56] References Cited

U.S. PATENT DOCUMENTS

| | | | |
|---|---|---|---|
| 4,434,937 | 3/1984 | Pitchford | 239/230 |
| 4,496,103 | 1/1985 | Pitchford | 239/230 |
| 4,498,626 | 2/1985 | Pitchford | 239/230 |
| 4,537,356 | 8/1985 | Lawson | 239/230 |

*Primary Examiner*—Jeffrey V. Nase
*Assistant Examiner*—David P. Davidson
*Attorney, Agent, or Firm*—Fulwider, Patton, Rieber, Lee & Utecht

[57] ABSTRACT

A reaction drive sprinkler including an improved drive nozzle assembly for rotating the sprinkler in steps about a water supply standpipe. The drive nozzle assembly comprises a fixed drive nozzle through which an inclined stream of irrigation water is projected for passage through a diverter tube mounted in front of the drive nozzle for movement between forward- and reverse-drive positions. The diverter tube is shifted between the forward- and reverse-drive positions by a spring-loaded, over-center reversing mechanism for slightly diverting the water stream for alternated interruption by a pair of laterally oppositely angled deflector spoons on a pivoting reaction drive arm. More particularly, the diverter tube directs the water stream for cyclic interruption by one of the deflector spoons to rotate the sprinkler stepwise in a forward rotational direction through a selected arcuate path and then shifts the diverter tube to direct the water stream for interruption by the other deflector spoon for stepwise sprinkler rotation in the reverse direction. Axially offset surface discontinuities within the diverter tube interact with the water stream to impart laterally directed forces to the diverter tube during movement between the forward- and reverse-drive positions to prevent the diverter tube from stalling in a neutral or centered position.

16 Claims, 17 Drawing Figures

FIG. 1
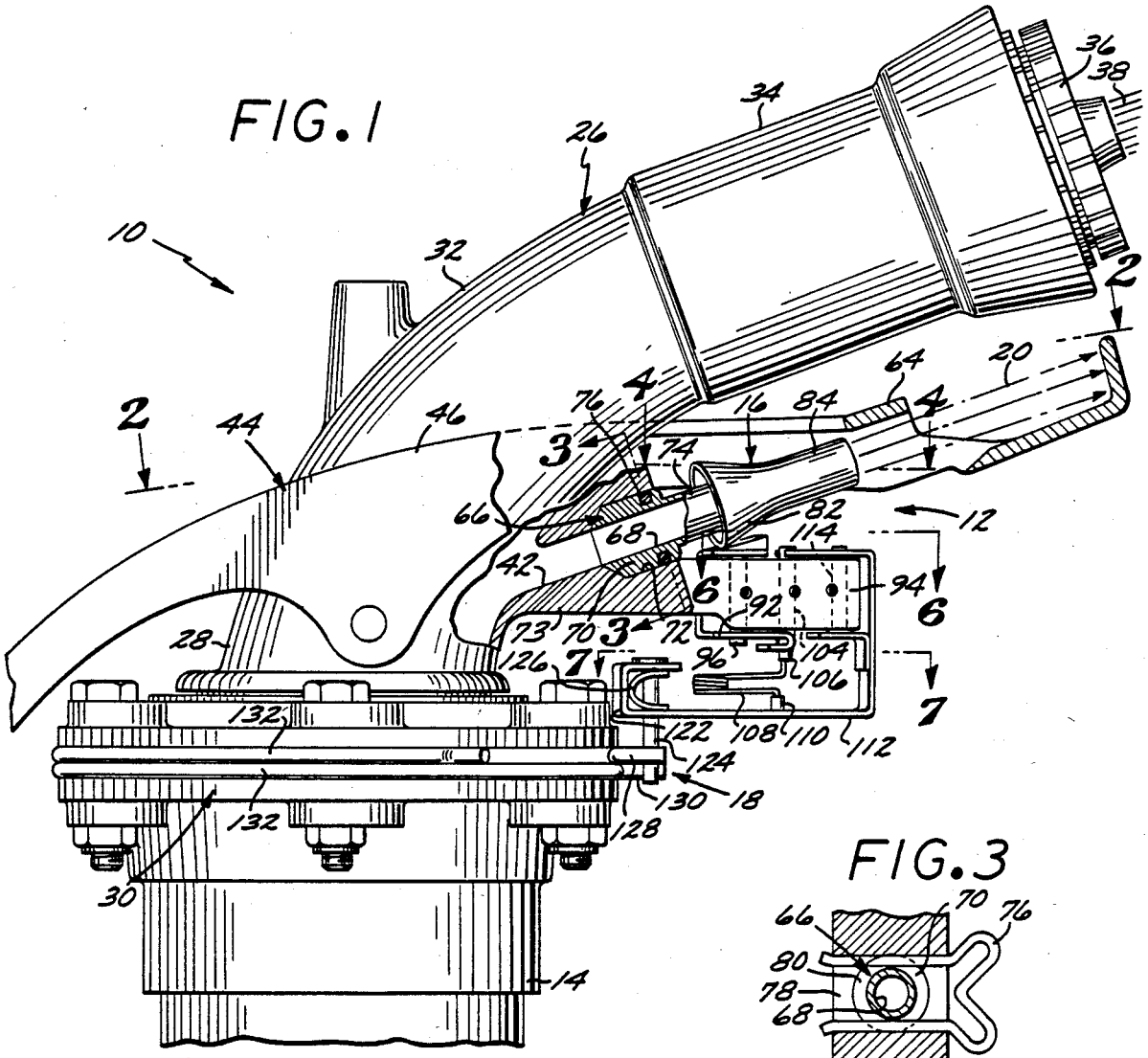
FIG. 3
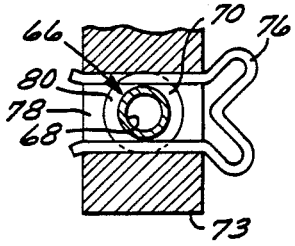
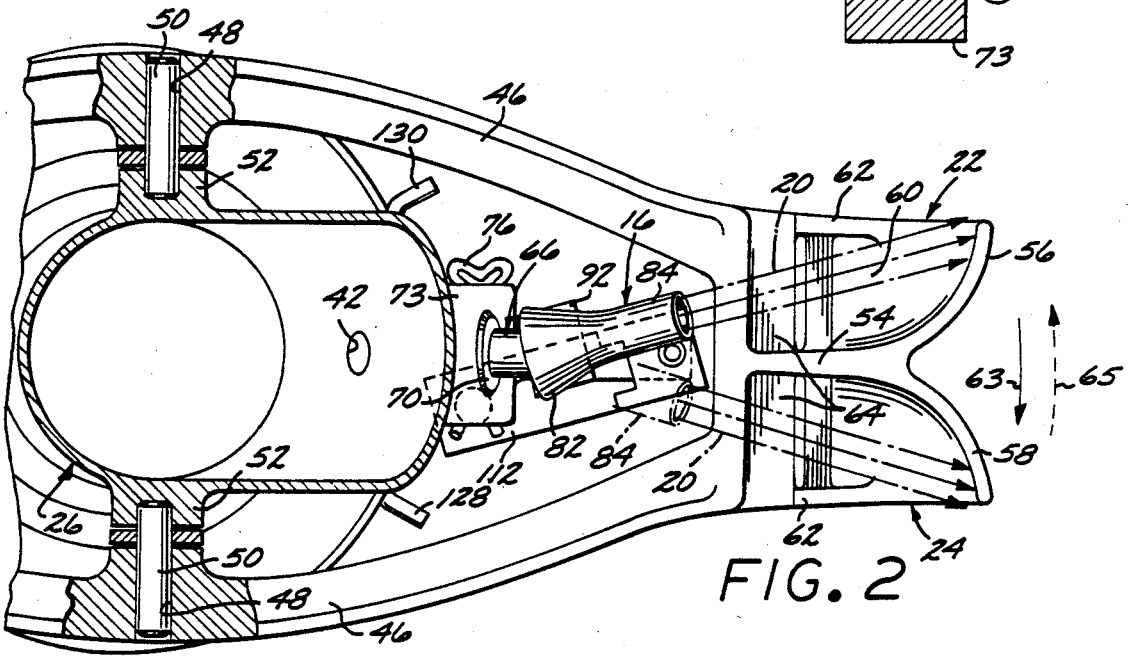
FIG. 2

30
76
66
82
16
73
114
84
74
68
92
63

30
76
65
66
114
112
82
16
84
128

30
92
106
102
100
118
104
112
96
114
124
16
102
116
94
120
128
63
122

30
124
65
92
116
114
122
94
104
100
112
16
128

30
114
108
126
110
124
112
63
128
122

30
124
65
112
126
122
108
114
128

DRIVE NOZZLE ASSEMBLY FOR A REACTION DRIVE SPRINKLER

BACKGROUND OF THE INVENTION

This invention relates generally to rotatable irrigation sprinklers particularly of the type including a reaction drive member for interacting cyclically with a projected water stream to rotate the sprinkler in steps and thereby alter the azimuthal direction of the water stream. More specifically, this invention relates to an improved reaction drive sprinkler of the general type disclosed and claimed in U.S. Pat. No. 4,434,937, and more particularly, to an improved drive nozzle assembly of the general type disclosed and claimed in copending application Ser. No. 607,579, filed May 7, 1984, now U.S. Pat. No. 4,537,356.

Rotatable water sprinklers of the so-called reaction drive type are known in the art for supplying irrigation water over a substantial surface area to irrigate lawns, crops, and the like. Such reaction drive sprinklers typically comprise a sprinkler body supported by a bearing assembly for rotation about the upper end of a water supply standpipe. Irrigation water under pressure supplied through the standpipe flows upwardly through the sprinkler body and is discharged outwardly through a discharge outlet or nozzle with a selected angle of upward inclination. A reaction drive arm is mounted on the sprinkler body for pivoting movement typically within a generally vertical plane and is appropriately counterweighted to swing a laterally open curved deflector spoon cyclically into interrupting engagement with the projected water stream. The water stream interacts with the deflector spoon to swing the spoon away from the stream and further to impart a lateral torque transmitted through the drive arm to the sprinkler body to rotate the sprinkler through a relatively small step, after which the drive arm returns the deflector spoon for subsequent water stream interruption and sprinkler rotation through a subsequent step. Accordingly, the deflector spoon interrupts the water stream in a cyclic fashion to rotate the sprinkler through a series of relatively small steps thereby correspondingly altering the direction of throw of the projected water stream. This stepwise movement can be allowed to continue through repeated full-circle rotations, or alternatively, if desired, a suitable reversing mechanism can be provided to reverse the direction of rotation within the limits of a preselected arcuate path.

Reaction drive water sprinklers of the type described have been used widely in agricultural irrigation systems requiring a relatively high flow water stream to be projected a substantial distance from the sprinkler. In this type of sprinkler, sometimes referred to as a large gun or big gun sprinkler, the deflector spoon interacts with the high energy water stream to drive the sprinkler in steps in one rotational direction. For part-circle operation, a reversing mechanism responds to sprinkler movement reaching one end limit of a selected arcuate path to move a reversing cam into interrupting engagement with the high energy stream. This results in a relatively high reaction force swinging the sprinkler rapidly back through the arcuate path to the other end limit whereupon the reversing cam is retracted from the water stream and normal stepwise rotation by means of the deflector spoon is resumed. Commercial examples of the foregoing type of reaction drive sprinkler are typified by the Model 102 and Model 103 Rain Guns manufactured by Rain Bird Sprinkler Mfg. Corp. of Glendora, Calif. In such reversible reaction drive sprinklers, the provision of a reversing cam and related actuating components undesirably increases the overall cost and complexity of the sprinkler. Moreover, reversing cam engagement with the high energy water stream can cause extremely rapid reversed rotational movement which can in turn contribute to excessive component wear and/or failure of mechanical components. Still further, interruption of the high energy water stream by the deflector spoon and the reversing cam knocks down a portion of the stream thereby effectively reducing sprinkler range.

In U.S. Pat. No. 4,434,937, an improved reaction drive sprinkler is disclosed of the so-called large or big gun type. This improved reaction drive sprinkler includes a relatively large range tube through which a high flow, high energy water stream is projected a substantial distance from the sprinkler, together with a comparatively smaller drive nozzle through which a secondary, significantly lower energy water stream is projected for reversible driving purposes. This lower energy water stream is interrupted in a cyclic manner by one of a pair of oppositely curved deflector spoons carried on a pivoting reaction drive arm, with the drive nozzle being formed from a flexible rubber-based or plastic material movable to aim the lower energy stream for engagement with either deflector spoon in accordance with the desired direction of rotational sprinkler stepping movement. The flexible drive nozzle can thus be set to rotate the sprinkler stepwise through a full-circle path in either direction or the drive nozzle can be switched by a typically spring-loaded, over-center reversing mechanism back and forth to achieve reversible sprinkler stepwise rotation within the limits of a preselected arcuate path. While this use of the relatively low energy stream for driving purposes advantageously results in controlled sprinkler movement in both rotational directions together with reduced component wear, the flexible drive nozzle does not provide optimally consistent drive performance particularly when subjected to varying operating parameters, such as temperature or pressure. For example, variations in these and other parameters can produce variant physical characteristics for the lower energy drive stream thereby resulting in inconsistent reaction drive forces and sometimes making it difficult to aim the stream for proper interaction with the selected deflector spoon.

In U.S. Pat. No. 4,537,356, an improved drive assembly is disclosed for use with a reaction drive sprinkler of the type described in the aforesaid U.S. Pat. No. 4,437,937. More particularly, a fixed drive nozzle of rigid material construction is provided for aiming a low energy drive stream through a diverter tube having a flared inlet end. This diverter tube is moved back and forth by the sprinkler reversing mechanism to slightly divert the drive stream alternately for forward- or reverse-drive interaction with the two, oppositely oriented deflector spoons. This combination drive nozzle and diverter tube advantageously avoids use of flexible nozzle materials for insuring accurate driving stream aim and control. However, in some circumstances, the movable diverter tube can hang up or stall in a neutral position centered between the forward- and reverse-drive positions, whereupon the sprinkler also becomes stalled and will not rotate as desired.

There exists, therefore, a need for a further improved drive nozzle assembly for a reaction drive sprinkler of the general type described in U.S. Pat. No. 4,434,937, wherein the improved drive nozzle assembly includes means for providing a relatively low energy water stream having substantially consistent drive characteristics, wherein this drive nozzle assembly can be shifted accurately back and forth for controlled interruption by two oppositely oriented deflector spoons, and wherein stalling of the drive nozzle assembly in a neutral position is avoided. The present invention fulfills this need and provides further related advantages.

SUMMARY OF THE INVENTION

In accordance with the invention, a reaction drive sprinkler is provided with an improved drive nozzle assembly for directing an outwardly projected stream of irrigation water into interrupting engagement with one of two laterally open, oppositely curved deflector spoons on a pivoting reaction drive arm. The drive assembly comprises a fixed drive nozzle through which the water stream is projected, and improved diverter means movably positioned between the drive nozzle and the deflector spoons for controlled slight diversion of the water stream into reaction engagement with the selected one of the deflector spoons. The diverter means is shifted by a springloaded, over-center reversing mechanism between a forward-drive position diverting the stream for engagement with one of the spoons to drive the sprinkler in a forward rotational direction and a reverse-drive position diverting the stream for engagement with the other spoon to drive the sprinkler in a reverse rotational direction. Internal surface discontinuities are formed within the diverter means and axially offset relative to each other for interaction with the water steam in a manner rendering the diverter means laterally unstable when in a neutral position centered between the forward- and reverse-drive positions.

In one preferred form of the invention, the diverter means comprises a diverter tube supported between the drive nozzle and the deflector spoons. This diverter tube has an enlarged flared inlet end for reception of the water stream discharged from the drive nozzle, wherein this inlet end converges to and merges with a generally cylindrical guide tube through which the stream is projected for impact engagement with the selected deflector spoon. A movable support bracket carries the diverter tube and is shifted by the reversing mechanism between the forward- and reverse-drive positions orienting the diverter tube for diverting the water stream laterally through a small angle into respective engagement with the two deflector spoons. A pair of laterally open vents are formed in opposite lateral sides of the diverter tube and bounded respectively by small vanes projecting slightly into the tube bore and axially offset relative to each other. When the diverter tube is in the neutral position, the vanes interact with the water stream to impart a lateral force to the diverter tube thereby insuring tube displacement away from the neutral position to prevent tube stalling in the neutral position.

In an alternative preferred form of the invention, the diverter tube includes a laterally opposed pair of dimples axially offset with respect to each other and projecting short distances into the tube bore. These dimples function in the same manner as the above-described vanes to impart a lateral force to the diverter tube when in the neutral position to prevent tube stalling.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a fragmented side elevation view of a reaction drive sprinkler, shown partially in vertical section, including an improved drive nozzle assembly embodying one preferred form of the invention;

FIG. 2 is a fragmented sectional view taken generally on the line 2—2 of FIG. 1;

FIG. 3 is a fragmented sectional view taken generally on the line 3—3 of FIG. 1;

DETAILED DESCRIPTION OF THE PREFERRED EMBODIMENT

Figure 4:
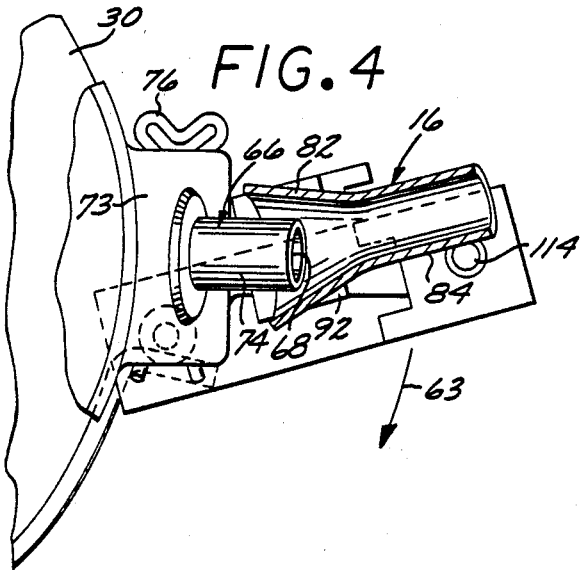
FIG. 4 is a fragmented sectional view through a portion of the drive nozzle assembly, taken generally on the line 4—4 of FIG. 1, and depicting the drive nozzle assembly in a forward-drive position.

As shown in the exemplary drawings, a reaction drive sprinkler referred to generally by the reference number 10 includes an improved drive nozzle assembly 12 for rotationally stepping the sprinkler in relatively small increments about the axis of a water supply standpipe 14. The drive nozzle assembly 12 includes a diverter tube 16 movably positioned by a reversing mechanism 18 between forward- and reverse-drive positions for slightly diverting a relatively low energy water stream 20 into driving engagement with a selected one of a respective pair of oppositely curved deflector spoons 22 and 24 to control the direction of sprinkler stepping movement. Surface discontinuities within the diverter tube 16 prevent the diverter tube from stalling in a neutral position thereby insuring positive shifting between the forward- and reverse-drive positions.

The reaction drive sprinkler 10 corresponds generally with the reaction drive sprinkler disclosed in commonly assigned U.S. Pat. No. 4,434,937, and in U.S. Pat. No. 4,537,356, with the inclusion of the improved drive nozzle assembly 12. More particularly, as shown best in FIGS. 1 and 2, the reaction drive sprinkler 10 comprises a sprinkler body of an appropriate metal casting or the like defining a relatively large bore range tube 26 having a lower end 28 rotationally supported by a bearing assembly 30 which in turn is adapted for mounting onto the upper end of the water supply standpipe 14. The lower end 28 of the range tube 26 extends upwardly from the bearing assembly 30 and merges smoothly with a curved elbow portion 32 joined in turn with an outwardly inclined discharge barrel 34 having a range tube nozzle 36 at its discharge end. The range tube 26 is thus rotatable within the bearing assembly 30 about a central axis of the standpipe 14, with the bearing assembly 30 having any convenient construction such as that described in U.S. Pat. No. 4,434,937 to accommodate such rotation.

Water under pressure supplied to the reaction drive sprinkler 10 flows upwardly through the water supply standpipe 14 and further upwardly through the range tube 26 for outward projection therefrom as a relatively high energy water stream 38 with a selected angle of inclination. This high energy stream 38 is swept over a substantial terrain surface area, by operation of the drive assembly 12 to be described which rotates the sprinkler through a succession of small rotational steps, to irrigate lawns, crops, and the like.

The reaction drive sprinkler 10 is rotatably driven by a relatively low energy water stream discharged from the elbow portion 32 of the range tube 26 and projected as the lower energy stream 20 for cyclic interaction with the deflector spoons 22 and 24. More particularly, as shown in the illustartive drawings, a relatively small and inherently relatively low pressure portion of the water flowing through the range tube 26 is passed through a bleed opening 42 disposed along the inside curvature of the range tube elbow portion 32, such that the bleed opening 42 is positioned at a location of substantial water energy losses resulting from localized turbulence and/or vortex swirl within the range tube, as recognized by U.S. Pat. No. 3,924,809. This low energy water passes through the bleed passage and is directed by the improved drive nozzle assembly 12 including the diverter tube 16 generally in parallel with the high energy stream 38 toward impact engagement with a selected one of the deflector spoons 22 and 24.

The deflector spoons 22 and 24 are supported at the forward end of a reaction drive arm 44 below the discharge barrel 34 of the range tube 26. The illustrative reaction drive arm 44 includes a pair of arm sections 46 extending rearwardly from the deflector spoons on opposite sides of the range tube 26, whereat the arm sections are shaped to define transversely aligned bores 48 for receiving relatively short pivot pins 50 seated in turn by set screws or the like (not shown) within outwardly open sockets 52 on the range tube 26. From the pivot pins 50, the arm sections 46 extend further rearwardly to a position behind the range tube where they are connected in a known manner to an appropriate counterweight (not shown) of selected mass for normally pivoting the deflector spoons upwardly through a generally vertical plane toward the range tube discharge barrel 34, all as shown and described in U.S. Pat. No. 4,434,937 which is incorporated by reference herein.

The deflector spoons 22 and 24 are defined by a central upstanding divider vane 54 common to both spoons and merging smoothly at its forward end with a laterally oppositely curved pair of upstanding deflector walls 56 and 58. The divider vane 54 and the deflector walls 56, 58 are formed integrally with a lower platform 60 joined to the arm sections 46 by a pair of short side struts 62. Accordingly, the two deflector spoons 22 and 24 are generally upwardly open and further are open in opposite lateral directions to deflect water incident therewith in opposite directions.

In operation, the counterweighted reaction drive arm 44 pivots gravitationally to swing the deflector spoons in an upward direction toward interrupting engagement with the projected low energy water stream 20. Conveniently, as is well known in the art, cross vanes 64 pass laterally between the arm sections 46 for initial engagement by the water stream 20 to pull the spoons relatively sharply in an upward direction for full engagement of the selected spoon 22 or 24 with the water stream. As shown best in FIG. 2, when the drive nozzle assembly 12 is positioned to guide the stream 20 for engagement with the spoon 22, the low energy water stream is deflected by the associated curved deflector wall 56 laterally away from the spoon 22 resulting in a reaction force imparted to the spoon and transmitted through the reaction arm 44 to the range tube 26 thereby rotating the range tube through a relatively small angular increment in a forward direction (arrow 63) with respect to the standpipe 14. Conversely, when the drive assembly diverts the stream 20 for engagement with the other spoon 24, as depicted by dotted lines in FIG. 2, an oppositely directed reaction force results to rotatably drive the range tube 26 through a small step in a reverse direction represented by arrow 65. In either case, the reaction force also drives the deflector spoons downwardly out of engagement with the water stream 20 against the counterweighted mass, whereupon the drive arm 44 eventually overcomes the downward driving force and swings the spoons back upwardly toward interrupting engagement with the water stream and for reaction driving of the range tube through a subsequent incremental step.

The improved drive nozzle assembly 12 for controlling the direction of the low energy stream 20 comprises a fixed drive nozzle 66 of a durable abrasion-resistant rigid material, such as brass or the like, retained in seated alignment with the bleed opening 42 and defining a rigid nozzle bore 68 through which the low energy water stream 20 is discharged with highly consistent physical characteristics particularly independent of temperature fluctuations. More specifically, as shown in the exemplary drawings, the drive nozzle 66 comprises an enlarged cylindrical base 70 having a generally frusto-conical seat surface for sealing and seated engagement within a matingly shaped counterbore 72 formed in an enlarged seat portion 73 through which the bleed opening 42 extends. This nozzle base 70 is formed integrally with an elongated nozzle tube 74 projecting upwardly and outwardly generally in parallel with the discharge barrel 34 of the range tube 26. The drive nozzle 66 is retained in position by a generally U-shaped retainer spring 76 having its legs receivable through a laterally open slot 78 in the range tube locked within an external annular groove 80 in the nozzle base 70, as shown best in FIGS. 1 and 3.

The improved drive nozzle assembly 12 of the present invention further includes the diverter tube 16 formed preferably from a metal such as stainless steel, although other materials such as molded plastic or the like can be used. The diverter tube is supported by the reversing mechanism 18 in a position generally between the drive nozzle 66 and the deflector spoons 22 and 24. In the preferred form, this diverter tube 16 has an enlarged or flared inlet end 82 with a diameter somewhat greater than the discharge diameter of the nozzle tube 74 for collecting and receiving the low energy water stream 20 projected from the drive nozzle 66 with an initial direction aimed generally toward the central divider vane 54 common to the two spoons. This flared inlet end 82 of the diverter tube 16 merges smoothly with and transitions into a generally cylindrical guide tube 84 from which the low energy stream 20 is guidingly discharged for impact engagement by a selected one of the deflector spoons 22 and 24. More particularly, the reversing mechanism 14 shifts the diverter tube 16 back and forth between the first position represented by solid lines in FIG. 2 for laterally diverting the stream 20 from its normal course through a small angle for impact engagement with the deflector spoon 22 thereby reaction driving the sprinkler in steps in the forward direction of arrow 63. Alternatively, the reversing mechanism 18 moves the diverter tube 16 to the second position shown in dotted lines in FIG. 2 for slightly laterally diverting the water stream 20 into impact engagement with the deflector spoon 24, thereby reaction driving the sprinkler in the reverse rotational direction as indicated by arrow 65 in FIG. 2. Importantly, in both cases the angle of stream diversion is sufficiently small, say about 10 degrees, to avoid any significant reduction in stream drive energy.

In accordance with a primary aspect of the invention, the diverter tube 16 includes internal surface discontinuities for rendering the tube laterally unstable when in a neutral position generally centered between the forward- and reverse-drive positions, thereby preventing the diverter tube from stalling or hanging up in a neutral position.

More particularly, as shown best in FIGS. 9–13, in one preferred form, the diverter tube 16 is formed to include a laterally opposed pair of side vents 17 and 19 defined respectively by a pair of upstream-facing vanes 21 and 23 struck inwardly from the sides of said tube. These vents 17 and 19, and their respective vanes 21 and 23 are slightly offset or staggered in a longitudinal or axial direction relative to each other. Accordingly, when the low energy water stream passes through the diverter tube 16, the stream interacts with the vanes 21 and 23 to impart laterally unstable forces to the tube tending to draw the tube laterally toward the forward- or the reverse-drive position, depending upon the particular angle of incidence of the stream relative to the vanes. The lateral instability is particularly pronounced when the diverter tube is in the neutral position due to the axially staggered nature of the vanes whereby the stream displaces the tube from said neutral position. Hanging up or stalling of the diverter tube in the neutral position which would otherwise prevent stepwise sprinkler rotation is thus avoided.

An alternative preferred construction for the diverter tube is depicted in FIGS. 14–17, wherein components identical to those shown and described in FIGS. 10–13 are identified by common primed reference numerals. As shown, this alternative diverter tube 16' has an enlarged or flared rear inlet end 82' merging smoothly with a substantially cylindrical guide tube 84' through which the low energy water stream is aimed for alternate forward- or reverse-drive interaction with the deflector spoons 22 and 24. This diverter tube 16' includes a pair of laterally opposed side dimples 25 and 27 formed to project short distances into the tube bore at longitudinally or axially staggered positions in the same manner as previously described with respect to the vanes 21 and 23. In operation, these dimples 25 and 27 interact with the water stream passing through the diverter tube 16' to impart laterally directed instability forces to the diverter tube, wherein these forces have a pronounced effect when said diverter tube 16' is in the neutral position to prevent the diverter tube from hanging up or stalling in the neutral position. Positive forward- or reverse-drive movement of the sprinkler as desired is thus assured.

The above-described diverter tubes 16 and 16' are designed for similar switching movement back and forth between the forward- and reverse-drive positions by operation of the reversing mechanism 18, which can take any convenient form, such as that described in detail in U.S. Pat. No. 4,537,356, which is incorporated by reference herein. More particularly, for completeness of description and with reference to FIGS. 4–9, which illustrate one preferred reversing mechanism construction, the diverter tube 16 (or 16') is secured as by welding onto the upper end of a support bracket 92 which is in turn pivoted by a pivot pin 96 onto a support arm 94 projecting forwardly from the seat portion 73. The lower end of this support bracket 92 includes a forwardly open, generally U-shaped recess 100 (FIG. 6) bounded by forwardly projecting legs 102 for respectively contacting at the forward- and reverse-drive diverter tube positions, respectively, a stop pin 104 on the support arm. The support bracket 92 further carries a downwardly open boss 106 at a position near the forward recess 100 to capture one end of an over-center trip spring 108 having its opposite end captured in an upwardly presented boss 110 on an actuator arm 112.

The actuator arm 112 is pivoted on the support arm 94 by a forward pivot pin 114, with an upper bracket portion of the actuator arm including a rearward recess 116 bounded by rearwardly projecting legs 118 and 120 for respectively contacting the stop pin 104. The actuator arm 112 extends downwardly from the support arm 94 and rearwardly past the lower boss 110 and terminates in a U-shaped end 122 which supports a downwardly extending trip pin 124. Conveniently, a C-shaped clip spring 126 releasably retains the trip pin 124 in a downwardly extending position.

Figure 5:
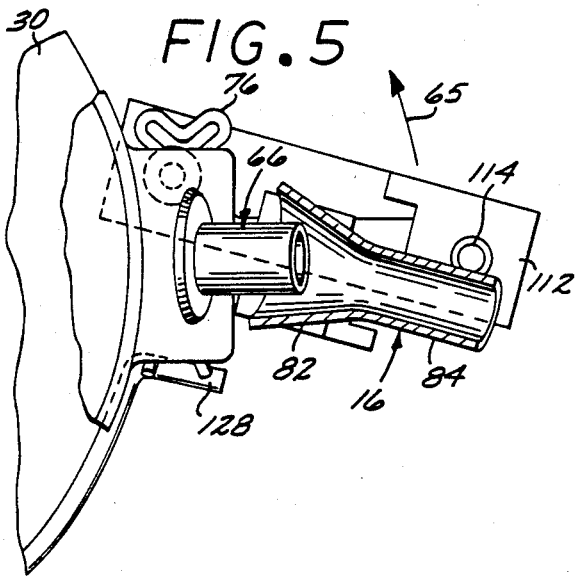
FIG. 5 is a fragmented sectional view similar to FIG. 4 but illustrating the drive nozzle assembly in a reverse-drive position.
Figure 6:
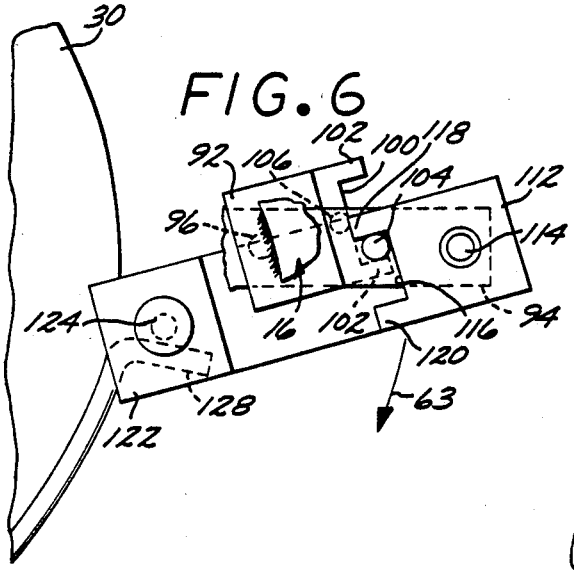
FIG. 6 is a fraqmented sectional view of a portion of a reversing mechanism, taken generally on the line 6—6 of FIG. 1 and depicting the reversing mechanism in a forward-drive position.
Figure 8:
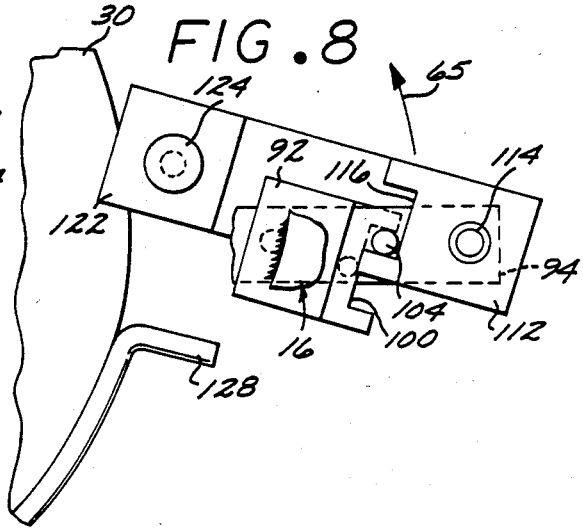
FIG. 8 is a fragmented sectional view similar to FIG. 6 but illustrating the reversing mechanism in the reverse-drive position.
Figure 7:
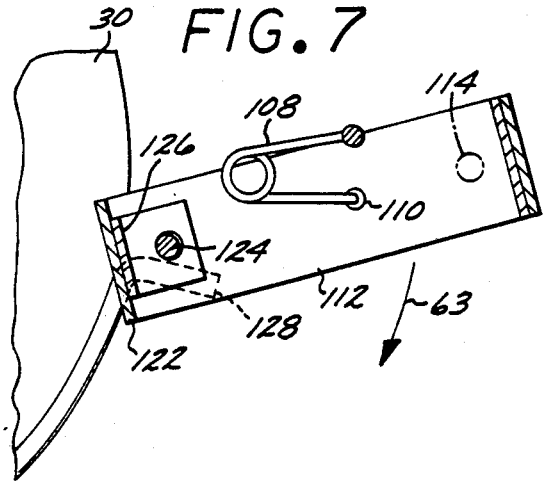
FIG. 7 is a fragmented sectional view through a further portion of the reversing mechanism, taken generally on the line 7—7 of FIG. 1.
Figure 9:
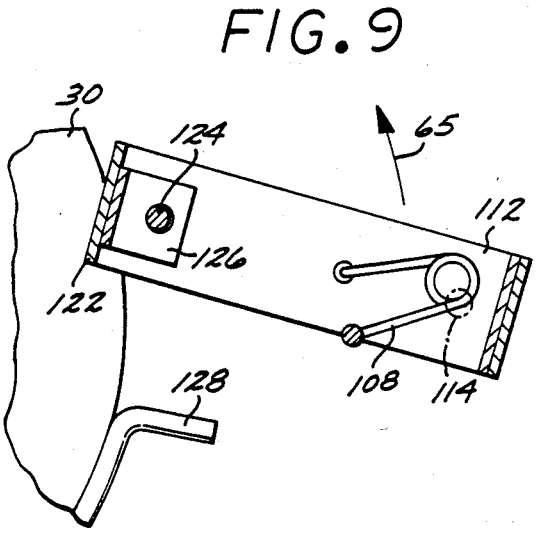
FIG. 9 is a fragmented sectional view similar to FIG. 7 but illustrating the reversing mechanism in the reverse-drive position.
Figure 10:
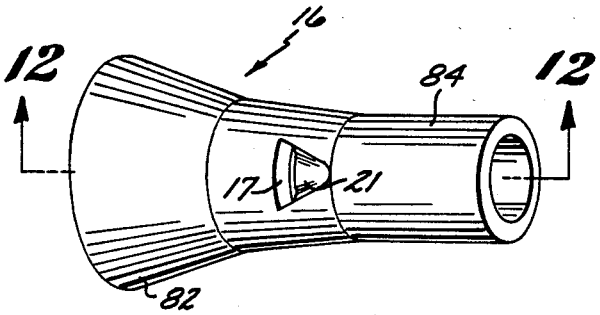
FIG. 10 is a perspective view illustrating one preferred diverter tube geometry for use in the improved drive nozzle assembly.
Figure 11:
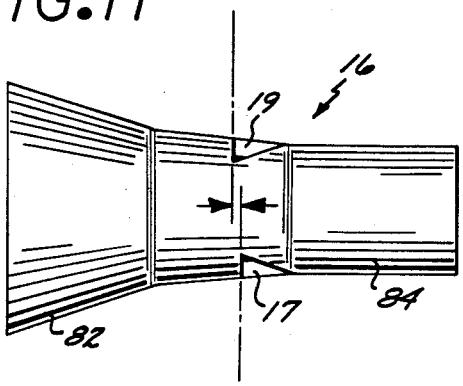
FIG. 11 is a top plan view of the diverter tube of FIG. 10.
Figure 12:
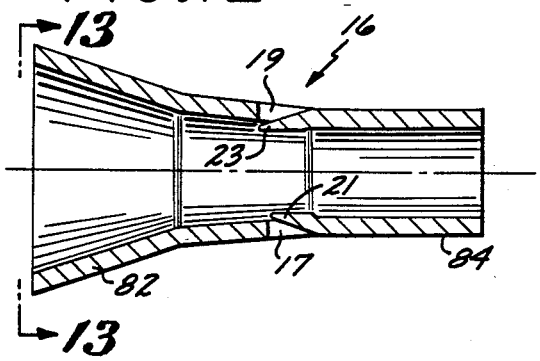
FIG. 12 is a longitudinal horizontal sectional view taken generally on the line 12—12 of FIG. 10.
Figure 13:
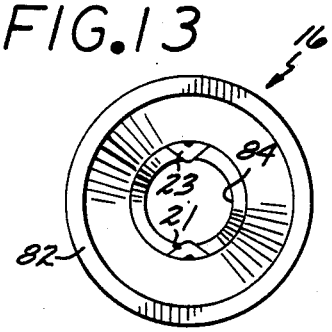
FIG. 13 is an upstream end elevation view taken generally on the line 13—13 of FIG. 12.
Figure 14:
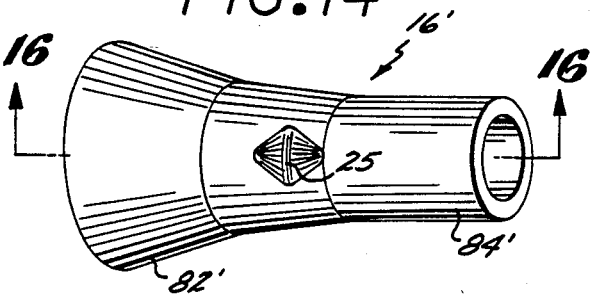
FIG. 14 is a perspective view illustrating another preferred diverter tube geometry for use in the improved drive nozzle assembly.
Figure 15:
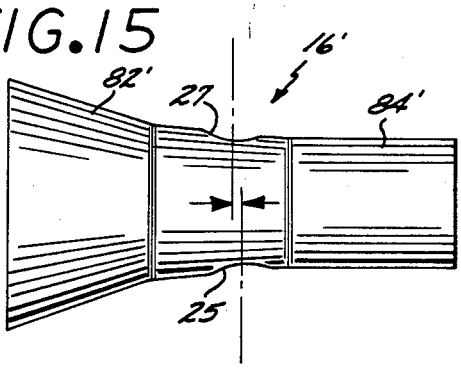
FIG. 15 is a top plan view of the diverter tube of FIG. 14.
Figure 16:
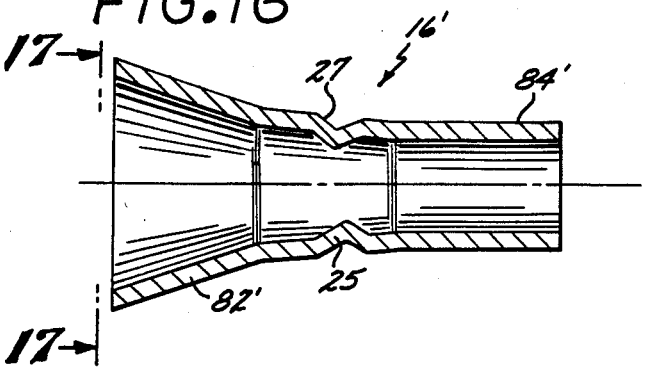
FIG. 16 is a longitudinal horizontal sectional view taken generally on the line 16—16 of FIG. 14.
Figure 17:
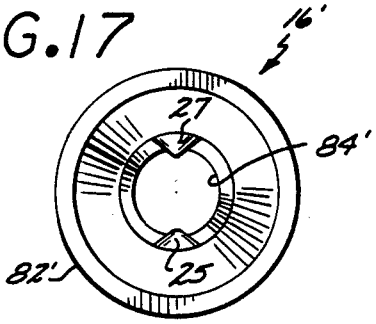
FIG. 17 is an upstream end elevation view taken generally on the line 17—17 of FIG. 16.

The trip pin 124 is positioned to engage outwardly projecting tabs 128 and 130 at the ends of clamp springs 132 and 134 wrapped about the bearing assembly 30, wherein these tabs 128 and 130 can be selectively positioned about the circumference of the bearing assembly 30 to define the opposite end limits of a preselected arcuate path within which sprinkler rotation is desired. When the sprinkler rotation in a forward direction, as depicted by arrow 63, reaches the end limit defined by the tab 128, as viewed in FIGS. 4, 6, and 7, the trip pin 124 engages the tab 128 to pivot the actuator arm 114 relative to the support arm 94, thereby operatively pivoting the support bracket 92 via the trip spring 108 to the second position, as shown in FIGS. 5, 8, and 9. This pivoting movement of the support bracket 92 shifts the diverter tube 16 to the reverse-drive position for guiding the low energy water stream 20 into interaction with the other deflector spoon 24. When this occurs, rotational stepping movement of the sprinkler reverses and continues in the opposite direction, as indicated by arrow 65, until the trip pin 124 engages the other clamp spring tab 130 thereby activating the reversing mechanism 18 to return the diverter tube 16 to its original forward-drive position and reverse the direction of stepping motion.

The improved drive nozzle assembly 12 thus provides a relatively simple and substantially maintenance free diverter means for shifting the low energy water stream 20 into engagement with the selected deflector spoon 22 or 24 to controllably drive the sprinkler 10 in the desired rotational direction. This controlled directional driving is advantageously accomplished by reliable and consistent drive forces which are not significantly impacted by ambient temperatures, time of service, or other facts. Moreover, the diverter means is rendered laterally unstable when in a neutral centered position to prevent undesired stalling in such centered position.

A variety of modifications and improvements to the improved drive nozzle assembly for a reaction drive sprinkler described herein are believed to be apparent to those skilled in the art. Accordingly, no limitation on the invention is intended by way of the description herein, except as set forth in the appended claims.

What is claimed is:

1. A rotatable water sprinkler comprising:

a range tube having a flow path therethrough for receiving water from a water supply pipe and for discharge projection of the water generally outwardly therefrom, said range tube further defining a relatively small bleed opening for bleed passage of a relatively small water stream from said flow path;

means for rotatably mounting said range tube on the water supply pipe;

a fixed drive nozzle on said range tube for discharge projection of the relatively small water stream outwardly from the sprinkler;

drive means pivoted with respect to said range tube and including first and second oppositely oriented deflector spoons for interrupting engagement with the relatively small water stream to rotatably drive said range tube respectively in forward and reverse rotational directions with respect to the water supply pipe;

diverter means movable between a forward-drive position for guiding the relatively small water stream discharged from said drive nozzle in a first direction for interrupting engagement by said first deflector spoon and a reverse-drive position for guiding said small water stream in a second direction for interrupting engagement by said second deflector spoon, said diverter means including means for preventing stalling of said diverter means in a neutral position centered generally between said forward- and reverse-drive positions; and reversing means responsive to the rotational position of said range tube with respect to the water supply pipe for shifting said diverter means between said forward- and reverse-drive positions.

2. The rotatable water sprinkler of claim 1 wherein said diverter means comprises a diverter tube disposed generally in front of said drive nozzle for passage therethrough of the relatively small water stream, said diverter tube slightly diverting the path of the small water stream in said first and second directions when said diverter tube is in said forward- and reverse-drive positions, respectively.

3. The rotatable water sprinkler claim of 2 wherein said diverter tube is movable laterally between said forward- and reverse-drive positions, said means for preventing stalling comprising means for rendering said diverter tube laterally unstable in response to passage of the small water stream therethrough.

4. The rotatable water sprinkler of claim 3 wherein said laterally unstable means comprises stream interrupting means projecting from at least one side of said diverter tube into the path of the small water stream passing through said diverter tube.

5. The rotatable water sprinkler of claim 3 wherein said laterally unstable means comprises a laterally opposed and longitudinally offset pair of side vents each bounded by a respective vane presented generally in an upstream direction.

6. The rotatable water sprinkler of claim 3 wherein said laterally unstable means comprises a laterally opposed and longitudinally offset pair of dimples.

7. The rotatable water sprinkler of claim 2 wherein said diverter tube has an outwardly flared inlet end for receiving the small water stream, said inlet end converging into a generally cylindrical guide tube portion for guiding the small water stream toward said first and second deflector spoons.

8. The rotatable water sprinkler of claim 1 wherein said range tube has an inlet end portion for rotatable mounting with respect to the water supply pipe, a discharge barrel portion disposed angularly with respect to said inlet end portion, and a smoothly curved elbow portion between said inlet end and barrel portions, and wherein said bleed opening is formed generally along the inside curvature of said elbow portion.

9. The rotatable water sprinkler of claim 1 wherein said reversing means comprises spring-loaded over-center means for switching said diverter means between said forward- and reverse-drive positions.

10. A rotatable water sprinkler, comprising:

a range tube for receiving water from a water supply pipe and for discharge of the water in the form of two water streams projected generally in an outward direction with respect to the supply pipe;

means for mounting said range tube to the water supply pipe for rotation with respect thereto and for receiving water therefrom;

a drive nozzle mounted on said range tube for discharge passage of one of said water streams;

drive means pivoted with respect ot said range tube and including oppositely oriented deflector spoons for respective interruption of said one stream for driving said range tube respectively in forward and reverse rotational directions about the water supply pipe;

diverter means generally between said drive nozzle and said deflector spoons and movable between a forward-drive position diverting said one stream for interruption by one of said spoons and a reverse-drive position diverting said one stream for interruption by the other of said spoons, said diverter means including means for preventing stalling of said diverter means in a neutral position centered generally between said forward- and reverse-drive positions; and a reversing mechanism for moving said diverter means between said forward- and reverse-drive positions.

11. The rotatable water sprinkler of claim 10 wherein said diverter means comprises a diverter tube for passage and slight angular diversion of said one stream in a first direction when said diverter tube is in said forward-drive position and a second direction when said diverter tube is in said reverse-drive position.

12. The rotatable water sprinkler of claim 11 wherein said means for preventing stalling comprises a laterally opposed and longitudinally offset pair of side vents each bounded by a respective vane presented generally in an upstream direction.

13. The rotatable water sprinkler of claim 11 wherein said means for preventing stalling comprises a laterally opposed and longitudinally offset pair of dimples.

14. For use in a rotatable water sprinkler having a range tube for rotatable connection with respect to a water supply pipe to receive water from the supply pipe and to project the water in the form of at least one water stream in a generally outward direction with a selected angle of inclination with respect to the supply pipe, a drive nozzle assembly, comprising:

a drive nozzle for mounting on the range tube for discharge passage of the water stream;

a diverter tube positioned generally downstream from said drive nozzle, said diverter tube having an outwardly flared inlet end for receiving the water stream for passage thereof through said diverter tube, said diverter tube further including at least one internal surface discontinuity for interrupting interaction with said water stream for imparting a lateral instability force to said diverter tube; and means for laterally switching said diverter tube between a forward-drive position and a reverse-drive position for respectively slightly deflecting said water stream in first and second different directions;

said surface discontinuity preventing stalling of said diverter tube between said forward- and reverse-drive positions.

15. The drive nozzle assembly of claim 14 wherein said surface discontinuity comprises a laterally opposed and longitudinally offset pair of side vents each bounded by a respective vane presented generally in an upstream direction.

16. The drive nozzle assembly of claim 14 wherein said surface discontinuity comprises a laterally opposed and longitudinally offset pair of dimples.

* * * * *